US008059999B2

(12) United States Patent
Inoue et al.

(10) Patent No.: US 8,059,999 B2
(45) Date of Patent: Nov. 15, 2011

(54) BELT CONVEYOR AND IMAGE FORMING APPARATUS

(75) Inventors: Mutsumi Inoue, Osaka (JP); Nobuhiro Nishioka, Osaka (JP)

(73) Assignee: Kyocera Mita Corporation (JP)

( * ) Notice: Subject to any disclaimer, the term of this patent is extended or adjusted under 35 U.S.C. 154(b) by 673 days.

(21) Appl. No.: 12/176,713

(22) Filed: Jul. 21, 2008

(65) Prior Publication Data

US 2009/0028615 A1 Jan. 29, 2009

(30) Foreign Application Priority Data

Jul. 25, 2007 (JP) ..... 2007-193887

(51) Int. Cl.
*G03G 15/00* (2006.01)
*G03G 15/01* (2006.01)

(52) U.S. Cl. ..... 399/302; 399/167

(58) Field of Classification Search ..... 399/101, 399/167, 302, 308
See application file for complete search history.

(56) References Cited

U.S. PATENT DOCUMENTS 5,963,769 A 10/1999 Emukai et al.

FOREIGN PATENT DOCUMENTS

CN 1161661 C 8/2004
JP 2004-45631 2/2004

*Primary Examiner* — David Gray
*Assistant Examiner* — Gregory H Curran
(74) *Attorney, Agent, or Firm* — Gerald E. Hespos; Michael J. Porco

(57) ABSTRACT

An image forming apparatus is provided with an image bearing member for bearing a toner image in conformity with specified image information, a transfer belt mounted on a plurality of rollers for transferring the toner image on the image bearing member to the outer surface thereof or a recording sheet placed on the outer surface thereof, a bending roller whose outer circumferential surface presses the outer surface of the transfer belt to bend the belt inwardly, a torque limiter having a specified cutoff torque and mounted on a rotary shaft of the bending roller, a drive motor for giving a driving force to the bending roller via the torque limiter, and a drive controller for driving the drive motor such that the circumferential speed of the bending roller is faster than the rotating speed of the transfer belt.

8 Claims, 4 Drawing Sheets

BELT CONVEYOR AND IMAGE FORMING APPARATUS

BACKGROUND OF THE INVENTION

1. Field of the Invention

The present invention relates to a belt conveyor and an image forming apparatus provided with this belt conveyor.

2. Description of the Related Art

A known image forming apparatus such as a color printer is provided with: a plurality of image bearing members (photoconductive drums) for bearing toner images of different colors; an intermediate transfer belt to which the toner images on the respective image bearing members are successively transferred in a superimposed manner by rotating a plurality of rollers; and a bending roller (pressure roller) for bending the intermediate transfer belt inwardly by coming into contact with the outer side of the intermediate transfer belt (see, for example, Japanese Unexamined Patent Publication No. 2004-45631). In this image forming apparatus, a color toner image formed on the outer surface of the intermediate transfer belt is transferred as a color image to a separately fed sheet. The sheet having the toner image transferred thereto is discharged to the outside after a fixing process is applied in a fixing unit.

In the image forming apparatus, the intermediate transfer belt is bent inwardly by the bending roller to make a space taken up by the intermediate transfer belt smaller and to make the apparatus smaller by arranging an other device (specifically, the fixing unit) in a space saved thereby.

When the outer circumferential surface of the bending roller comes into contact with the outer surface of the intermediate transfer belt, residual toner on the intermediate transfer belt adheres and deposits on the outer circumferential surface of this bending roller and this toner adheres to the intermediate transfer belt again in some cases. If the residual toner adhered again to the intermediate transfer belt is transferred to the sheet, a problem of reducing image quality is caused.

In the above image forming apparatus, a cleaning member for cleaning the outer circumferential surface of the bending roller is provided to solve such a problem. In this way, the outer circumferential surface of the bending roller is constantly kept clean. A drive motor for driving the bending roller is also provided to prevent the difficulty of the bending roller to rotate due to a resistance by the contact of the cleaning member with the outer circumferential surface of the bending roller.

By doing so, the bending roller reliably rotates according to the rotation of the intermediate transfer belt despite the resistance caused by providing the cleaning member. Further, the outer circumferential surface of the bending roller is constantly cleaned. In this way, the image forming apparatus prevents the occurrence of an image defect in a toner image transferred to a sheet.

However, since the intermediate transfer belt and the bending roller are respectively driven by different driving sources in the above image forming apparatus, it is very difficult to set the rotating speed of the intermediate transfer belt and the circumferential speed of the bending roller equal to each other.

Specifically, in the intermediate transfer belt, there are cases where the rotating speed of the intermediate transfer belt varies due to the rotation nonuniformity of the driving source, belt speed nonuniformity caused by an error in dimensional accuracy and the like. In the bending roller as well, there are cases where the rotating speed of the bending roller varies to change the circumferential speed of the bending roller due to the rotation nonuniformity of the driving source, the dimensional accuracy of the roller, the speed nonuniformity of the roller surface caused by twist accuracy and the like. Thus, it is impossible to constantly set the rotating speed of the intermediate transfer belt and the circumferential speed of the bending roller equal, and the outer surface of the intermediate transfer belt and the outer circumferential surface of the bending roller abrade against each other at different speeds in the above image forming apparatus.

If the outer surface of the intermediate transfer belt and the outer circumferential surface of the bending roller abrade against each other, there are cases where the intermediate transfer belt is scratched and a transfer potential is made nonuniform to cause a transfer failure. Further, there are cases where these surfaces are ground to produce fine particles and these fine particles adversely affect a toner image transferred to a sheet to reduce image quality.

SUMMARY OF THE INVENTION

An object of the present invention is to provide a belt conveyor capable of effectively preventing a failure resulting from a difference between the rotating speed of a belt and the circumferential speed of a bending roller and an image forming apparatus provided with this belt conveyor.

In order to accomplish this object, one aspect of the present invention is directed to a belt conveyor, comprising: a plurality of rollers; a belt mounted on the plurality of rollers; a bending roller whose outer circumferential surface presses the outer surface of the belt to bend the belt inwardly; a torque limiter having a specified cutoff torque and mounted on a rotary shaft of the bending roller; a drive motor for giving a driving force to the bending roller via the torque limiter; and a drive controller for driving the drive motor such that the circumferential speed of the bending roller is faster than the rotating speed of the belt.

Another aspect of the present invention is directed to an image forming apparatus, comprising: an image bearing member for bearing a toner image in conformity with specified image information; a transfer belt mounted on a plurality of rollers for transferring the toner image on the image bearing member to the outer surface thereof or a recording sheet placed on the outer surface thereof; a bending roller whose outer circumferential surface presses the outer surface of the belt to bend the belt inwardly; a torque limiter having a specified cutoff torque and mounted on a rotary shaft of the bending roller; a drive motor for giving a driving force to the bending roller via the torque limiter; and a drive controller for driving the drive motor such that the circumferential speed of the bending roller is faster than the rotating speed of the transfer belt.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, one specific embodiment of the present invention is described with reference to the accompanying drawings.

Figure 1:
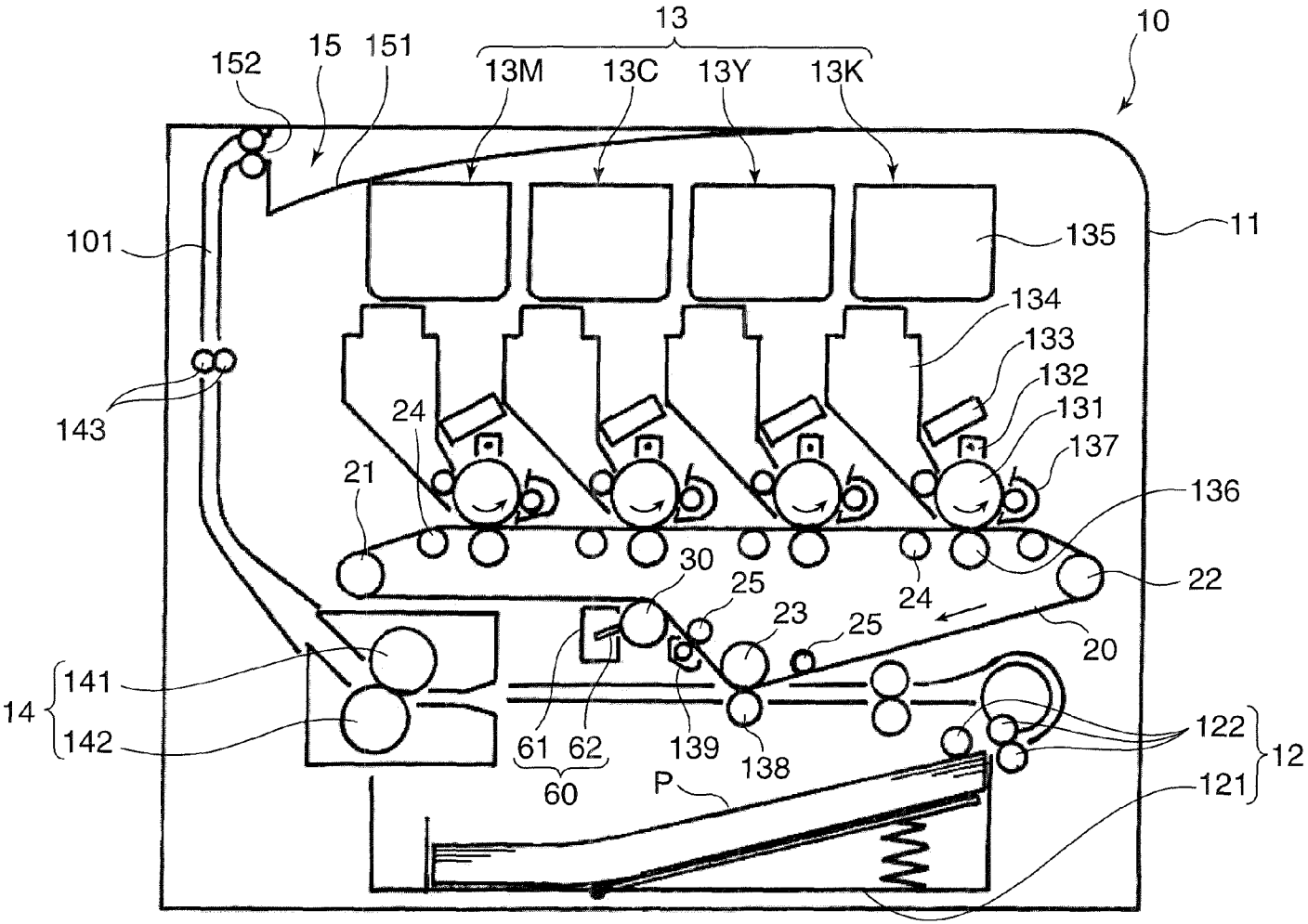
FIG. 1 is a section showing the internal construction of an image forming apparatus according to one embodiment of the invention.

FIG. 1 is a section showing the internal construction of an image forming apparatus according to one embodiment of the invention. In this embodiment, a printer 10 is adopted as the image forming apparatus. As shown in FIG. 1, in the printer 10, a sheet feeding unit 12 for storing a stack of sheets P, an image forming assembly 13 for transferring a toner image to a sheet P conveyed from the sheet feeding unit 12, a fixing unit 14 for applying a fixing process to the toner image transferred to the sheet P in the image forming assembly 13 and a sheet discharge unit 15, to which the sheet P having the fixing process applied thereto in the fixing unit 14 is discharged, are installed in a printer main body 11.

The sheet feeding unit 12 includes a sheet cassette 121 detachably mounted in a bottom part of the printer main body 11 and capable of storing a plurality of sheets P, and pickup rollers 122 disposed at right upper positions of the sheet cassette 121 in FIG. 1. The sheets P stored in the sheet cassette 121 are picked up one by one by driving the pickup rollers 122 and fed to the image forming assembly 13.

The image forming assembly 13 forms a toner image on the sheet P fed from the sheet feeding unit 12. In this embodiment, a magenta unit 13M using a magenta toner, a cyan unit 13C using a cyan toner, a yellow unit 13Y using a yellow toner and a black unit 13K using a black toner are successively arranged from an upstream side (left side in the plane of FIG. 1) toward a downstream side.

Each of the respective units 13M, 13C, 13Y and 13K includes: a photoconductive drum (image bearing member) 131, on the outer circumferential surface of which an electrostatic latent image and a toner image in conformity with this electrostatic latent image are formed and which is rotatable about an axis extending in forward and backward directions (directions orthogonal to the plane of FIG. 1); a charger 132 having a charging wire for applying a charging process to the outer circumferential surface of the photoconductive drum 131 to uniformly charge this outer circumferential surface; an exposing device 133 for forming an electrostatic latent image by irradiating the outer circumferential surface of the photoconductive drum 131 uniformly charged by the charger 132 with a laser beam based on image information; a developing device 134 for forming a toner image on the outer circumferential surface of the photoconductive drum 131 by supplying the toner to this outer circumferential surface where the electrostatic latent image is formed; a toner container 135 detachably attached to the developing device 134 for supplying the toner to the developing device 134; a primary transfer roller 136 for transferring the toner image on the photoconductive drum 131 to the outer surface of an intermediate transfer belt (transfer belt) 20 to be described later by electrostatically separating the toner image; and a drum cleaning device 137 for cleaning the outer circumferential surface of the photoconductive drum 131 after a transfer process to the intermediate transfer belt 20.

The image forming assembly 13 also includes a belt conveyor below the respective photoconductive drums 131 as a member common to the respective units 13M, 13C, 13Y and 13K. The belt conveyor includes: the intermediate transfer belt 20 held in contact with the respective photoconductive drums 131 at an upper side to have the toner images on the outer circumferential surfaces of the photoconductive drums 131 transferred thereto; a secondary transfer roller 138 for transferring the toner image on the intermediate transfer belt 20 to a sheet P fed from the sheet feeding unit 12 by electrostatically separating the toner image; and a belt cleaning device 139 for cleaning the outer surface of the intermediate transfer belt 20 after the transfer process to the sheet P.

Each photoconductive drum 131 forms an electrostatic latent image and a toner image in conformity with the electrostatic latent image on the outer circumferential surface thereof. An amorphous silicon layer, which is tough, good in abrasion resistance and very smooth, is formed on the outer circumferential surface of the photoconductive drum 131. Thus, the photoconductive drum 131 is suitable for forming these images. Each photoconductive drum 131 receives the supply of the toner from the corresponding developing device 134 while being rotated in a counterclockwise direction in FIG. 1.

The charger 132 uniformly charges the outer circumferential surface of the photoconductive drum 131 by corona discharge through the application of a high voltage from an unillustrated power supply to the charging wire. Instead of the charger 132, a charging roller applied with a high voltage may be held in contact with the outer circumferential surface of the photoconductive drum 131 to thereby charge the outer circumferential surface of the photoconductive drum 131.

The exposing device 133 irradiates the outer circumferential surface of the photoconductive drum 131 uniformly charged by the charger 132 with a laser beam based on image data inputted from an unillustrated computer or the like. An electrostatic latent image is formed on the outer circumferential surface of the photoconductive drum 131 by this irradiation of the laser beam. By supplying the toner from the developing device 134 to this electrostatic latent image, a toner image is formed on the outer circumferential surface of the photoconductive drum 131 and transferred to the rotating intermediate transfer belt 20.

The developing device 134 is internally provided with an agitating/conveying member and a developing roller whose outer circumferential surface is facing the outer circumferential surface of the photoconductive drum 131, the developing roller being disposed at a bottommost position. The toner is supplied to the outer circumferential surface of the photoconductive drum 131 by the rotation of this developing roller.

Figure 2:
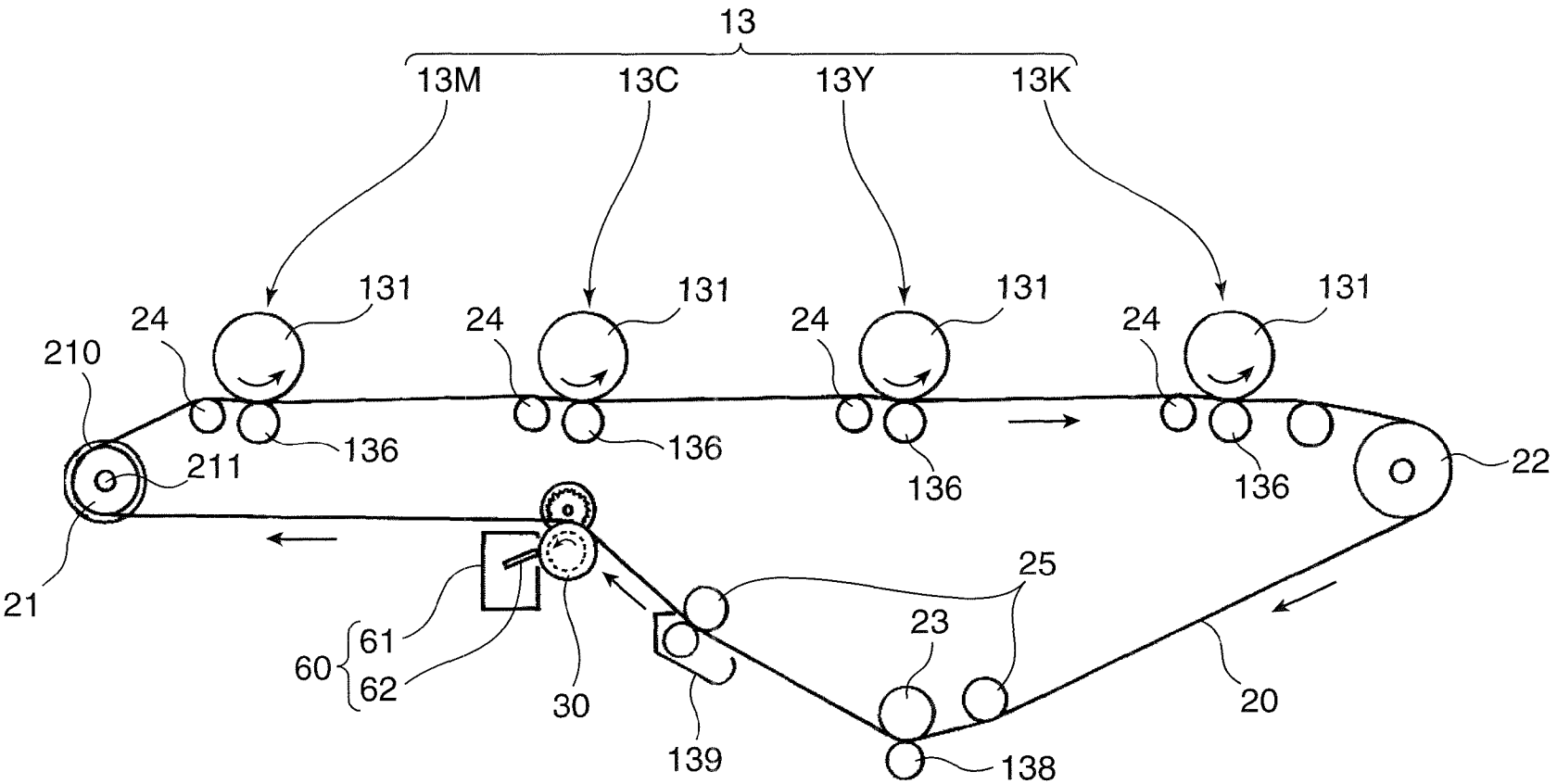
FIG. 2 is a diagram showing rollers corresponding to an intermediate transfer belt of FIG. 1.

FIG. 2 is a diagram showing the respective rollers corresponding to the intermediate transfer belt of FIG. 1. As shown in FIG. 2, the toner images formed on the outer circumferential surfaces of the photoconductive drums 131 in the respective units 13M, 13C, 13Y and 13K are successively transferred in a superimposed manner to the outer surface of the intermediate transfer belt 20, whereby a color toner image is formed on the outer surface of the intermediate transfer belt 20.

The intermediate transfer belt 20 is mounted on: the primary transfer rollers 136 of the respective units 13M, 13C, 13Y and 13K; a drive roller 21 disposed slightly to the left of the primary transfer roller 136 of the magenta unit 13M in FIG. 2; a driven roller 22 disposed slightly to the right of the primary transfer roller 136 of the black unit 13K in FIG. 2; and a pressing roller 23 disposed between and below the drive roller 21 and the driven roller 22.

The secondary transfer roller 138 is disposed at a position right below the pressing roller 23 with the intermediate transfer belt 20 held therebetween. The pressing roller 23 presses the intermediate transfer belt 20 against the secondary transfer roller 138. In other words, the secondary transfer roller 138 is pressed by the pressing roller 23 via the intermediate transfer belt 20. A bias voltage for electrostatically separating the toner image on the intermediate transfer belt 20 is applied from an unillustrated power supply to the secondary transfer roller 138. Accordingly, the toner image on the intermediate transfer belt 20 is transferred to a sheet P passing between the intermediate transfer belt 20 and the secondary transfer roller 138. In other words, the color toner image on the outer surface of the intermediate transfer belt 20 is reliably transferred to the sheet P being conveyed while being sandwiched between the intermediate transfer belt 20 and the secondary transfer roller 138.

The drive roller 21 is driven by a belt driving motor 210. The belt driving motor 210 is disposed concentrically with the drive roller 21 at the rear side of the drive roller 21 (at the back side of the plane of FIG. 2). The drive roller 21 is so fitted on a drive shaft 211 of the belt driving motor 210 as to be integrally rotatable. Accordingly, the drive roller 21 is integrally rotated about the driving shaft 211 by driving the belt driving motor 210.

A bending roller 30 for bending the intermediate transfer belt 20 is disposed at a position substantially right below the primary transfer roller 136 of the cyan unit 13C to the right of the drive roller 21 in FIG. 2. The outer circumferential surfaces of all the above drive roller 21, driven roller 22, pressing roller 23 and primary transfer rollers 136 are held in contact with the inner surface of the intermediate transfer belt 20. On the contrary, the outer circumferential surface of the bending roller 30 is held in contact with the front surface of the intermediate transfer belt 20. Accordingly, the residual toner on the outer surface of the intermediate transfer belt 20 may be transferred to the outer circumferential surface of the bending roller 30, but this residual toner is removed as described in detail later in this embodiment.

An upper tension roller 24 is disposed at a position to the left of each primary transfer roller 136 in FIG. 2. On the other hand, lower tension rollers 25 are respectively disposed between the bending roller 30 and the pressing roller 23 and between the driven roller 22 and the pressing roller 23. These upper and lower tension rollers 24, 25 are for keeping the intermediate transfer belt 20 stretched so as not to slacken.

The belt cleaning device 139 for cleaning the outer surface of the intermediate transfer belt 20 after the transfer process to the sheet P is disposed at a position facing the left lower tension roller 25 in FIGS. 1 and 2 via the intermediate transfer belt 20. The intermediate transfer belt 20 cleaned by this belt cleaning device 139 heads for the photoconductive drums 131 of the respective units 13M, 13C, 13Y and 13K for a next transfer process after passing the bending roller 30.

Further, a roller cleaning device 60 for cleaning the outer circumferential surface of the bending roller 30 is disposed immediately to the left of the bending roller 30 in FIG. 2. This roller cleaning device 60 cleans the outer circumferential surface of the bending roller 30 by removing foreign matters such as the residual toner adhering to this outer circumferential surface.

The roller cleaning device 60 includes a box-shaped casing 61 and a blade 62 provided in this casing 61. The blade 62 is inclined such that the leading end thereof faces an upper right side in FIG. 2, and the upper end edge thereof is held in contact with the outer circumferential surface of the bending roller 30. Accordingly, when the intermediate transfer belt 20 is rotated in a clockwise direction, the bending roller 30 is rotated in a counterclockwise direction about a central axis thereof and the leading end edge of the blade 62 is held in sliding contact with the outer circumferential surface of the bending roller 30. In this way, the outer circumferential surface of the bending roller 30 is cleaned by having adhering foreign matters scraped off.

The fixing unit 14 shown in FIG. 1 includes: a fixing roller 141 heated by an electrical heating element such as a halogen lamp; and a pressure roller 142 arranged to face the fixing roller 141 from below such that the outer circumferential surface thereof presses the outer circumferential surface of the fixing roller 141. The fixing unit 14 applies a fixing process to the transfer image transferred to the sheet P in the image forming assembly 13.

The sheet P having the transfer process applied thereto by the intermediate transfer belt 20 in the image forming assembly 13 is introduced into the fixing unit 14 while being sandwiched between the intermediate transfer belt 20 and the secondary transfer roller 138 and guided by the rotation of the intermediate transfer belt 20. Then, the toner image is fixed to this sheet P by heat applied during the passage between the fixing roller 141 and the pressure roller 142. In this way, the fixing process is performed.

The sheet P after the fixing process is conveyed upward in a discharge conveyance path 101 by driving a pair of discharge rollers 143 and discharged onto a discharge tray 151 provided atop the printer main body 11 through a sheet discharge opening 152.

In this embodiment, the driven roller 22, the pressing roller 23, the upper tension rollers 24 and the lower tension rollers 25 are all rotated by the rotating movement of the intermediate transfer belt 20. On the contrary, the bending roller 30 is rotated by the driving of the roller driving motor (drive motor) 40 via the torque limiter.

Figure 3:
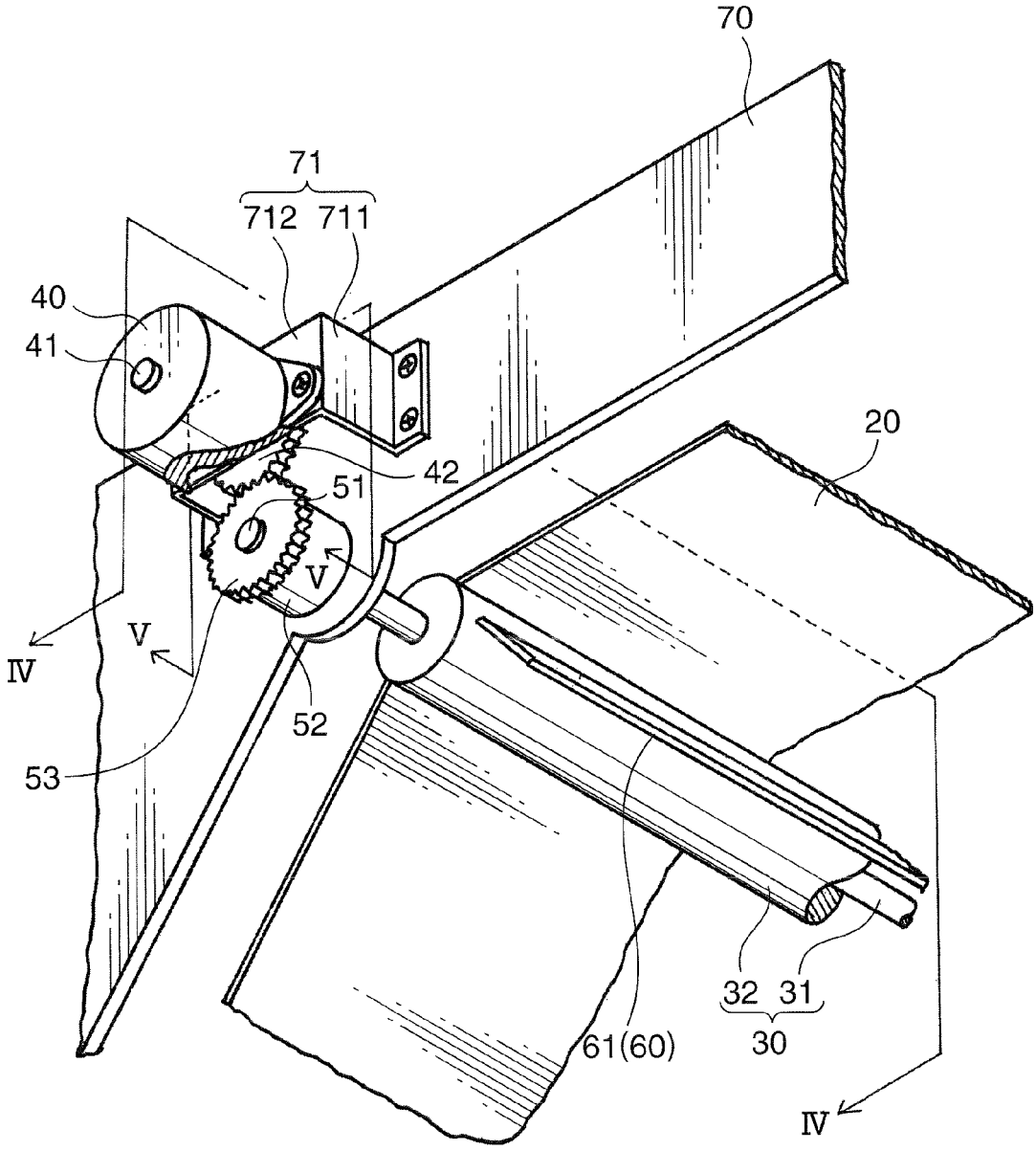
FIG. 3 is a perspective view partly cut away showing a bending roller, a roller driving motor and a torque limiter.
Figure 4:
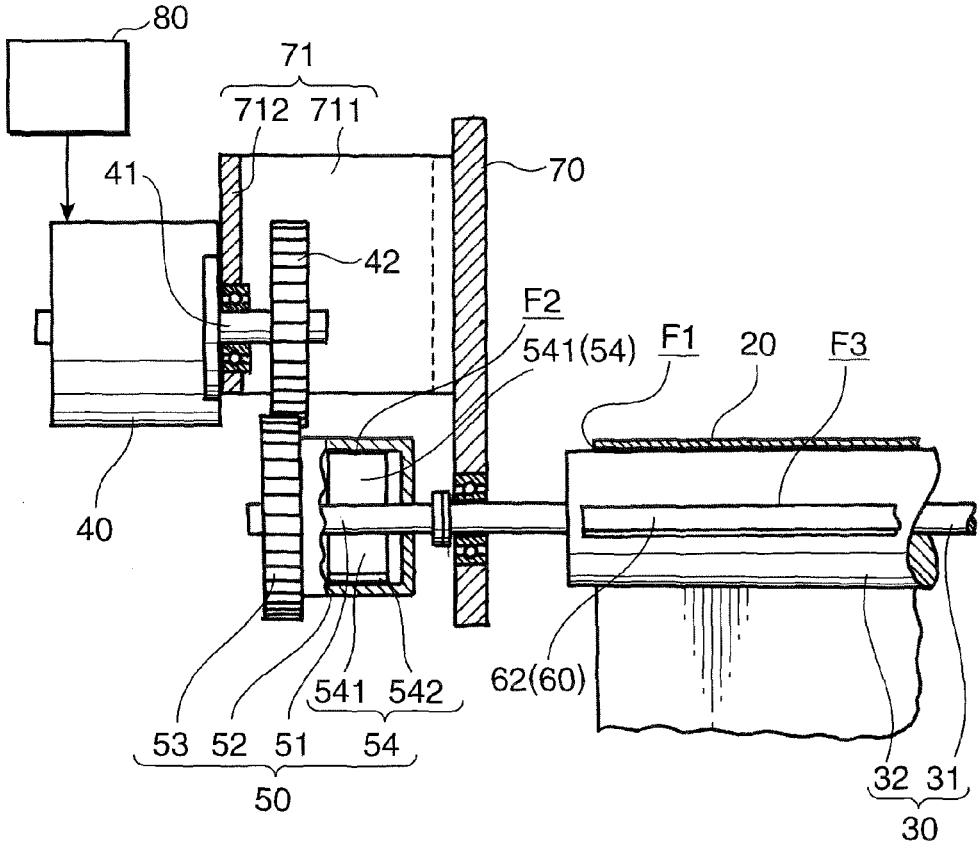
FIG. 4 is a section along IV-IV of FIG. 3.

FIG. 3 is a perspective view partly cut away showing the bending roller 30, the roller driving motor 40 and the torque limiter 50. FIG. 4 is a section along IV-IV of FIG. 3 and FIG. 5 is a section along V-V of FIG. 3.

As shown in FIG. 3, a pair of frame plates 70 facing each other in a direction orthogonal to the rotating direction of the intermediate transfer belt 20 are provided in the printer main body 11. The drive roller 21, the driven roller 22, the pressing roller 23, the bending roller 30 and other rollers are mounted between the pair of frame plates 70. FIG. 3 shows a part of one of the pair of frame plates 70 where the bending roller 30 is disposed.

The bending roller 30 includes: a bending roller shaft 31 extending between the pair of frame plates 70; and a bending roller main body 32 concentrically and integrally rotatably fitted on this bending roller shaft 31. The material of the bending roller main body 32 is, for example, an elastomer such as a rubber or a soft synthetic resin or a metal such as an aluminum alloy or a stainless steel.

Figure 5:
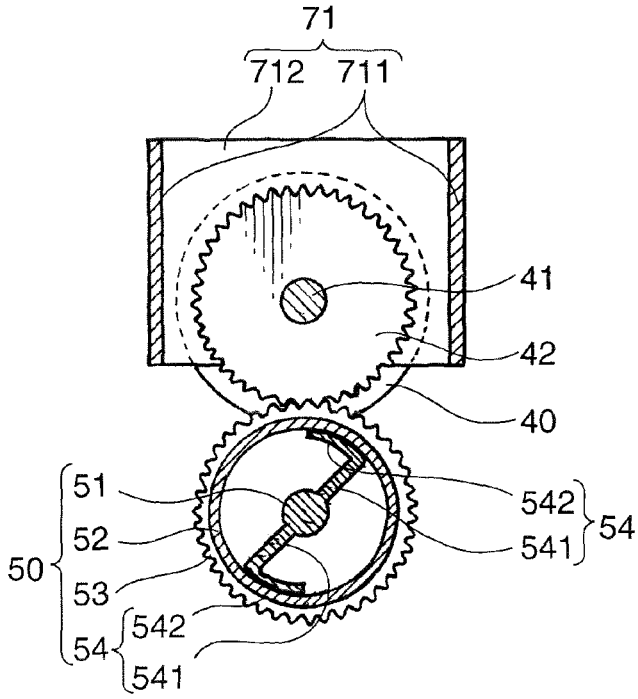
FIG. 5 is a section along V-V of FIG. 3.

As shown in FIGS. 4 and 5, the torque limiter 50 is concentrically mounted on an end of the bending roller shaft 31 projecting outwardly from the frame plate 70. The torque limiter 50 includes: a central shaft 51 integrally rotatable and concentrically connected with the bending roller shaft 31; a limiter tubular body 52 concentrically and relatively rotatably fitted on the central shaft 51; a limiter-side gear 53 concentrically and relatively rotatably fitted on the limiter tubular body 52; and a pair of resistive elements 54 projecting in opposite radially outward directions from the central shaft 51 in the limiter tubular body 52.

Each resistive element 54 is formed by bending a leaf spring into an L-shape and comprised of a rectangular flat plate portion 541 projecting from the central shaft 51 and an arcuate plate portion 542 bent at the leading end of the flat plate portion 541 to extend in a rotating direction of the central shaft 51 and having an arcuate shape so as to be held in surface contact with the inner circumferential surface of the limiter tubular body 52.

The arcuate plate portion 542 is accommodated in the limiter tubular body 52 with a joined part with the flat plate portion 541 slightly elastically deformed, and presses the inner circumferential surface of the limiter tubular body 52 with a specified elastic force. Thus, a specified frictional force (torque limiter frictional force F2) can be produced between the arcuate plate portion 542 and the limiter tubular body 52. By this torque limiter frictional force F2, the torque limiter 50 has a cutoff torque T2 resisting the rotation of the bending roller 30.

On the other hand, when the intermediate transfer belt 20 is rotated, a frictional force (roller-belt frictional force F1) produced between the bending roller main body 32 and the intermediate transfer belt 20 acts on the bending roller main body 32. A frictional force between the bending roller main body 32 and the intermediate transfer belt 20 is set such that "the cutoff torque T2 of the torque limiter 50" is smaller than "a torque T1 received by the bending roller 30 due to the roller-belt frictional force F1".

The blade 62 of the roller cleaning device 60 is in contact with the outer circumferential surface of the bending roller main body 32. A frictional force between the blade 62 and the bending roller main body 32 is set such that "a torque T3 received by the bending roller 30 due to a frictional force produced between the blade 62 and the outer circumferential surface of the bending roller main body 32 (blade-roller frictional force (load force) F3" is smaller than "the cutoff torque T2 of the torque limiter 50".

Accordingly, the respective frictional forces are set such that, among the torque T1 received by the bending roller 30 due to the roller-belt frictional force F1, the cutoff torque T2 of the torque limiter 50 and the torque T3 received by the bending roller 30 due to the blade-roller frictional force F3, T1 is largest, T2 is second largest and T3 is smallest (T1>T2>T3). A relationship of F1>F2>F3 is satisfied if the inner diameter of the limiter tubular body 52 and the diameter of the bending roller main body 32 are equal.

The roller driving motor 40 is mounted on a bracket 71 fixed to the outer surface of the frame plate 70 at a position right above the torque limiter 50. The bracket 71 includes a pair of side plates 711 projecting outwardly from the frame plate 70 and a rear plate 712 bridging the leading end edges of this pair of side plates 711. The roller driving motor 40 is mounted on the rear plate 712 with the drive shaft 41 thereof pierced through the rear plate 712.

A drive gear 42 in mesh with the limiter-side gear 53 is concentrically and integrally rotatably fitted on a part of the drive shaft 41 located in the bracket 71 through the rear plate 712. Accordingly, the drive of the roller driving motor 40 is transmitted to the limiter tubular body 52 of the torque limiter 50 via the drive shaft 41, the drive gear 42 and the limiter-side gear 53. The rotation of the limiter tubular body 52 is transmitted to the bending roller 30 via the resistive elements 54 and the central shaft 51.

In this embodiment, with the frictional forces as described above set, the speed of the roller driving motor 40 is set such that the circumferential speed of the bending roller main body 32 is faster than the rotating speed of the intermediate transfer belt 20 if the bending roller 30 is rotated in a state where the torque limiter 50 is not set (hereinafter, also referred to as a state subject to no restriction of the torque limiter 50), i.e. in a state where the bending roller 30 receives no load from the torque limiter 50 (in a free state) (hereinafter, also referred to as free rotation).

For such speed setting, a drive controller 80 (FIG. 4) including a microcomputer is provided at a suitable position in the printer main body 11. The roller driving motor 40 is controllably driven by this drive controller 80. Specifically, the rotating speed of the intermediate transfer belt 20 is inputted to the drive controller 80 beforehand. The drive controller 80 calculates the circumferential speed of the bending roller 30 to be faster than the rotating speed of the intermediate transfer belt 20 by a preset rate and outputs a control signal based on this calculation result to the roller driving motor 40. By the driving of the roller driving motor 40 having this control signal inputted thereto, the bending roller 30 tries to rotate slightly faster than the rotating speed of the intermediate transfer belt 20 during the free rotation subject to no restriction of the torque limiter 50.

When the roller driving motor 40 and the belt driving motor 210 are driven, the intermediate transfer belt 20 rotates by receiving a driving force of the belt driving motor 210. On the other hand, the bending roller main body 32 tries to rotate at a circumferential speed faster than the rotating speed of the intermediate transfer belt 20 by the driving of the roller driving motor 40.

A driving force of the roller driving motor 40 is transmitted to the bending roller 30 via the resistive elements 54 held in contact with the inner circumferential surface of the limiter tubular body 52 of the torque limiter 50, whereby a frictional force (torque limiter frictional force F2) is produced between the arcuate plate portions 542 of the resistive elements 54 and the inner circumferential surface of the limiter tubular body 52. Here, since the cutoff torque T2 of the torque limiter 50 specified by the torque limiter frictional force F2 is set smaller than the torque T1 received by the bending roller 30 due to a frictional force (roller-belt frictional force F1) between the intermediate transfer belt 20 and the bending roller main body 32, a slip occurs between the resistive elements 54 and the limiter tubular body 52. As a result, the bending roller main body 32 is in the same state as the one where it is rotated by the intermediate transfer belt 20 (i.e. the bending roller 30 is rotated at a circumferential speed equal to the rotating speed of the intermediate transfer belt 20).

Since a difference between the circumferential speed of the bending roller 30 and the rotating speed of the intermediate transfer belt 20 when the bending roller 30 freely rotates by the driving of the roller driving motor 40 is not very much, a degree of abrasion between the outer circumferential surface of the bending roller main body 32 and the outer surface of the intermediate transfer belt 20 can be reduced as compared with the case where the bending roller 30 is rotated only by the rotating movement of the intermediate transfer belt 20. Thus, such an inconvenience that foreign matters such as residual toner on the outer circumferential surface of the bending roller main body 32 adheres to the outer surface of the intermediate transfer belt 20 again due to the abrasion to deteriorate the quality of an image transferred to a sheet P can be effectively prevented.

On the other hand, since the respective frictional forces are set such that the torque T3 received by the bending roller 30 due to a frictional force (blade-roller frictional force F3) between the blade 62 and the bending roller main body 32 is smaller than the cutoff torque T2 of the torque limiter 50 specified by the torque limiter frictional force F2, such an inconvenience that the bending roller 30 does not rotate due to an excessive blade-roller frictional force F3 can be prevented.

Further, since the drive controller 80 outputs a control signal to the roller driving motor 40 upon performing an image forming process while rotating the intermediate transfer belt 20 in this embodiment, the roller driving motor 40 is set to start slightly earlier than the start of the belt driving motor 210. Since the driving force of the roller driving motor 40 is, in this way, transmitted to the bending roller 30 via the resistive elements 54 that are about to slip in the limiter tubular body 52 before the rotation of the intermediate transfer belt 20 (i.e. the bending roller 30 does not rotate since the intermediate transfer belt 20 is not rotating, but the driving force of the roller driving motor 40 is transmitted to the bending roller 30), the bending roller 30 can immediately follow the rotation of the intermediate transfer belt 20 when the intermediate transfer belt 20 is started, wherefore a degree of abrasion between the outer circumferential surface of the bending roller main body 32 and the outer surface of the intermediate transfer belt 20 at the start can be made as small as possible. In addition, the transfer of foreign matters on the outer circumferential surface of the bending roller main body 32 to the outer surface of the intermediate transfer belt 20 can be effectively suppressed.

As described in detail above, the printer 10 (image forming apparatus) according to this embodiment is provided with a plurality of photoconductive drums 131 for bearing toner images in accordance with specified image information and the intermediate transfer belt 20 mounted on a plurality of rollers (drive roller 21, driven roller 22, pressing roller 23, upper tension rollers 24, lower tension rollers 25, bending roller 30, etc.) and to have the toner images on the respective photoconductive drums 131 successively transferred thereto in a superimposed manner, and is capable of so-called color printing.

This printer (image forming apparatus, belt conveyor) 10 is provided with: a plurality of photoconductive drums (image bearing member) 131 for bearing toner images in accordance with specified image information; the intermediate transfer belt 20 mounted on a plurality of rollers and to have the toner images on the respective photoconductive drums 131 successively transferred to the outer surface thereof in a superimposed manner; the bending roller 30 whose outer circumferential surface presses the outer surface of the intermediate transfer belt 20 to bend the intermediate transfer belt 20 inwardly; the torque limiter 50 having the cutoff torque T2 and mounted on the rotary shaft of the bending roller 30; the roller driving motor 40 for giving a driving force to the bending roller 30 via the torque limiter 50; and the drive controller 80 for driving the roller driving motor 40 such that the circumferential speed of the bending roller 30 in the case of not being restricted by the torque limiter 50 is larger than the rotating speed of the intermediate transfer belt 20.

According to such a construction, since the roller driving motor 40 is controlled by the drive controller 80, if the rotating speed of the intermediate transfer belt 20 varies without exceeding the circumferential speed of the bending roller 30 in the case of not receiving the set restriction of the torque limiter 50 (circumferential speed during the free rotation), the torque limiter 50 absorbs such a variation (specifically, the speed variation of the intermediate transfer belt 20 is absorbed by a sliding motion of the torque limiter 50 relative to the bending roller 30). As a result, the bending roller 30 can be rotated such that the circumferential speed of the bending roller 30 and the rotating speed of the intermediate transfer belt 20 are equal.

Accordingly, the occurrence of such an inconvenience that the outer surface of the intermediate transfer belt 20 and the outer circumferential surface of the bending roller 30 abrade against each other due to a speed difference to scratch the intermediate transfer belt 20 and/or to adversely affect a transfer image to a sheet due to the production of fine particles can be effectively prevented.

In this embodiment, the cutoff torque T2 of the torque limiter 50 specified by the frictional force (torque limiter frictional force F2) produced between the arcuate plate portions 542 of the resistive elements 54 and the inner circumferential surface of the limiter tubular body 52 is set smaller than the torque T1 received by the bending roller 30 due to the frictional force (roller-belt frictional force F1) produced between the intermediate transfer belt 20 and the bending roller 30. By doing so, a slip occurs in the torque limiter 50, wherefore the circumferential speed of the bending roller 30 and the rotating speed of the intermediate transfer belt 20 can be reliably conformed.

Since the roller cleaning device 60 for cleaning the outer circumferential surface of the bending roller 30 is provided in this embodiment, foreign matters such as residual toner transferred from the outer surface of the intermediate transfer belt 20 to the outer circumferential surface of the bending roller 30 are cleaned by the roller cleaning device 60. In addition, an image failure resulting from the return of foreign matters on the outer circumferential surface of the bending roller 30 to the outer surface of the intermediate transfer belt 20 can be suppressed.

Further, in this embodiment, the roller-belt frictional force F1, the torque limiter frictional force F2 and the blade-roller frictional force (load force) F3 are set such that, among the torque T1 received by the bending roller 30 due to the roller-belt frictional force F1, the cutoff torque T2 of the torque limiter 50 and the torque T3 received by the bending roller 30 due to the blade-roller frictional force F3, T1 is largest, T2 is second largest and T3 is smallest (T1>T2>T3). Thus, the occurrence of such an inconvenience that the bending roller 30 does not rotate due to a load force of the roller cleaning device 60 can be reliably prevented.

Furthermore, since the bending roller 30 is started prior to the start of the intermediate transfer belt 20 when the intermediate transfer belt 20 is started in this embodiment, the bending roller 30 does not rotate by the action of the torque limiter 50 until the intermediate transfer belt 20 is started with the bending roller 30 started prior to the start of the intermediate transfer belt 20, but the bending roller 30 can immediately rotate following the rotation of the intermediate transfer belt 20 upon starting the intermediate transfer belt 20. Accordingly, in this embodiment, the bending roller 30 rotates following the start of the intermediate transfer belt 20 without any time lag when the intermediate transfer belt 20 is started, unlike the case where the intermediate transfer belt 20 and the bending roller 30 are simultaneously started. Therefore, the abrasion of the bending roller 30 and the intermediate transfer belt 20 resulting from a speed difference can be effectively prevented.

The present invention is not limited to the above embodiment and also embraces the following contents.

(1) The above embodiment is described, taking the printer 10 as an example of the image forming apparatus. According to the present invention, the image forming apparatus is not limited to the printer 10 and may be a copier, a facsimile machine or the like.

(2) In the above embodiment, the roller cleaning device 60 for cleaning the outer circumferential surface of the bending roller 30 is such that the blade 62 is provided in the casing 61. However, according to the present invention, a cleaning roller may be, instead, provided in the casing 61 and the outer circumferential surface of the bending roller 30 may be cleaned due to a circumferential speed difference between the outer circumferential surface of the cleaning roller and that of the bending roller 30.

(3) In the above embodiment, only one bending roller 30 is provided. However, according to the present invention, two or more bending rollers 30 may be provided in conformity with various rotation paths of the intermediate transfer belt 20 based on an arrangement layout of the photoconductive drums 131, the chargers 132, the exposing devices 133, the developing devices 134, the toner containers 135, the sheet cassette 121 and the like.

(4) In the above embodiment, the torque limiter 50 employed is of the type that the arcuate plate portions 542 of the resistive elements 54 are held in sliding contact with the inner circumferential surface of the limiter tubular body 52. However, according to the present invention, instead of the torque limiter 50 of such a type, various other torque limiters can also be employed such as the one of the clutch plate type constructed such that facing surfaces of clutch plates arranged to face each other are held in sliding contact with each other by a coil spring or the one in which a highly viscous fluid is sealed between a pair of clutch plates arranged to face each other.

(5) In the above embodiment, the intermediate transfer belt 20 for having a color toner image formed in a superimposed manner on the outer surface thereof is employed as the transfer belt. However, according to the present invention, a so-called sheet conveyor belt for having a color toner image formed on a sheet being conveyed thereby may be employed as the inventive transfer belt.

(6) In the above embodiment, a plurality of photoconductive drums 131 are provided for color printing as the image bearing members. However, the present invention is also applicable to an image forming apparatus of the so-called one-drum type in which toner images of the respective colors are successively formed on the outer circumferential surface of one photoconductive drum. Further, the image forming apparatus according to the present invention is not limited to the one for color printing, but may be for black-and-white printing. In this case, only one photoconductive drum is employed as the image bearing member as a matter of fact.

The above specific embodiment mainly embraces the inventions having the following constructions.

A belt conveyor according to one aspect of the present invention comprises: a plurality of rollers; a belt mounted on the plurality of rollers; a bending roller whose outer circumferential surface presses the outer surface of the belt to bend the belt inwardly; a torque limiter having a specified cutoff torque and mounted on a rotary shaft of the bending roller; a drive motor for giving a driving force to the bending roller via the torque limiter; and a drive controller for driving the drive motor such that the circumferential speed of the bending roller is faster than the rotating speed of the belt.

According to such a construction, the drive motor for driving the bending roller transmits the driving force to the bending roller via the torque limiter. In addition, the drive controller drives the drive motor such that the circumferential speed of the bending roller is faster than the rotating speed of the belt. Thus, the circumferential speed of the bending roller can constantly properly follow the rotating speed of the belt. In the case of varying the rotating speed of the belt without exceeding the circumferential speed of the bending roller, this variation is absorbed by the torque limiter (specifically, the speed variation of the belt is absorbed by mutual sliding movements of a specified sliding contact member in the torque limiter and a specified member of the bending roller). Therefore, the bending roller rotates such that the circumferential speed thereof is equal to the rotating speed of the belt.

Such an inconvenience that the outer surface of the belt and the outer circumferential surface of the bending roller abrade against each other due to a speed difference to scratch the belt and/or to produce fine particles can be effectively prevented.

In this construction, the cutoff torque of the torque limiter is preferably smaller than a torque received by the bending roller due to a friction between the belt and the bending roller.

According to such a construction, the specified sliding contact member slips in the torque limiter since the cutoff torque of the torque limiter is smaller than the torque received by the bending roller due to the friction between the belt and the bending roller. Thus, the circumferential speed of the bending roller can be reliably conformed to the rotating speed of the belt.

In these constructions, the belt conveyor preferably further comprises a cleaning device for cleaning the outer circumferential surface of the bending roller.

According to such a construction, the re-adherence of foreign matters on the outer circumferential surface of the bending roller to the belt can be suppressed since residual toner transferred from the outer surface of the belt to the outer circumferential surface of the bending roller is cleaned by the cleaning device.

In this case, the cutoff torque of the torque limiter is preferably larger than a torque received by the bending roller due to a friction between the cleaning device and the bending roller.

According to such a construction, the occurrence of such an inconvenience that the bending roller does not rotate due to a load force acting on the outer circumferential surface of the bending roller from the cleaning device can be prevented.

In these constructions, the drive controller preferably drives the drive motor in such a manner as to start the bending roller prior to the start of the belt.

According to such a construction, when the bending roller is started by the drive controller driving the drive motor before the belt is started, the bending roller does not rotate by the action of the torque limiter until the belt is started, but can rotate immediately upon starting the belt. Accordingly, if the belt is started, the bending roller can rotate following the start of the belt without any time lag, wherefore the abrasion of the bending roller and the belt due to the speed difference can be effectively prevented as compared with the case where they are simultaneously started.

An image forming apparatus according to another aspect of the present invention comprises: an image bearing member for bearing a toner image in conformity with specified image information; a transfer belt mounted on a plurality of rollers for transferring the toner image on the image bearing member to the outer surface thereof or a recording sheet placed on the outer surface thereof; a bending roller whose outer circumferential surface presses the outer surface of the transfer belt to bend the transfer belt inwardly; a torque limiter having a specified cutoff torque and mounted on a rotary shaft of the bending roller; a drive motor for giving a driving force to the bending roller via the torque limiter; and a drive controller for driving the drive motor such that the circumferential speed of the bending roller is faster than the rotating speed of the transfer belt.

According to such a construction, the drive motor for driving the bending roller transmits the driving force to the bending roller via the torque limiter. In addition, the drive controller drives the drive motor such that the circumferential speed of the bending roller is faster than the rotating speed of the transfer belt. Thus, the circumferential speed of the bending roller can constantly properly follow the rotating speed of the transfer belt. In the case of varying the rotating speed of the transfer belt without exceeding the circumferential speed of the bending roller, this variation is absorbed by the torque limiter (specifically, the speed variation of the transfer belt is absorbed by mutual sliding movements of a specified sliding contact member in the torque limiter and a specified member of the bending roller). Therefore, the bending roller rotates such that the circumferential speed thereof is equal to the rotating speed of the transfer belt.

Accordingly, the occurrence of such an inconvenience that the outer surface of the transfer belt and the outer circumferential surface of the bending roller abrade against each other due to a speed difference to scratch the transfer belt and/or to adversely affect a transfer image to a sheet due to the production of fine particles can be effectively prevented.

In this construction, the cutoff torque of the torque limiter is preferably smaller than a torque received by the bending roller due to a friction between the transfer belt and the bending roller.

According to such a construction, the specified sliding contact member slips in the torque limiter since the cutoff torque of the torque limiter is smaller than the torque received by the bending roller due to the friction between the transfer belt and the bending roller. Thus, the circumferential speed of the bending roller can be reliably conformed to the rotating speed of the transfer belt.

In these constructions, the image forming apparatus preferably further comprises a cleaning device for cleaning the outer circumferential surface of the bending roller.

According to such a construction, an image failure of the transfer image on the sheet resulting from foreign matters on the outer circumferential surface of the bending roller can be suppressed since residual toner transferred from the outer surface of the transfer belt to the outer circumferential surface of the bending roller is cleaned by the cleaning device.

In this case, the cutoff torque of the torque limiter is preferably larger than a torque received by the bending roller due to a friction between the cleaning device and the bending roller.

According to such a construction, the occurrence of such an inconvenience that the bending roller does not rotate due to a load force acting on the outer circumferential surface of the bending roller from the cleaning device can be prevented.

In these constructions, the drive controller preferably drives the drive motor in such a manner as to start the bending roller prior to the start of the transfer belt.

According to such a construction, when the bending roller is started by the drive controller driving the drive motor before the transfer belt is started, the bending roller does not rotate by the action of the torque limiter until the transfer belt is started, but can rotate immediately upon starting the transfer belt. Accordingly, if the transfer belt is started, the bending roller can rotate following the start of the transfer belt without any time lag, wherefore the abrasion of the bending roller and the transfer belt due to the speed difference can be effectively prevented as compared with the case where they are simultaneously started.

This application is based on patent application No. 2007-193887 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A belt conveyor, comprising:

a plurality of rollers;

a belt mounted on the plurality of rollers;

a bending roller whose outer circumferential surface presses the outer surface of the belt to bend the belt inwardly;

a torque limiter having a specified cutoff torque and mounted on a rotary shaft of the bending roller;

a drive motor for giving a driving force to the bending roller via the torque limiter; and a drive controller for driving the drive motor such that the circumferential speed of the bending roller is faster than the rotating speed of the belt, wherein the cutoff torque of the torque limiter is smaller than a torque received by the bending roller due to a friction between the belt and the bending roller.

2. A belt conveyor according to claim 1, further comprising a cleaning device for cleaning the outer circumferential surface of the bending roller.

3. A belt conveyor according to claim 2, wherein the cutoff torque of the torque limiter is larger than a torque received by the bending roller due to a friction between the cleaning device and the bending roller.

4. A belt conveyor comprising:

a plurality of rollers;

a belt mounted on the plurality of rollers;

a bending roller whose outer circumferential surface presses the outer surface of the belt to bend the belt inwardly;

a torque limiter having a specified cutoff torque and mounted on a rotary shaft of the bending roller;

a drive motor for giving a driving force to the bending roller via the torque limiter; and a drive controller for driving the drive motor such that the circumferential speed of the bending roller is faster than the rotating speed of the belt, wherein the drive controller drives the drive motor in such a manner as to start the bending roller prior to the start of the belt.

5. An image forming apparatus, comprising:

an image bearing member for bearing a toner image in conformity with specified image information;

a transfer belt mounted on a plurality of rollers for transferring the toner image on the image bearing member to the outer surface thereof or a recording sheet placed on the outer surface thereof;

a bending roller whose outer circumferential surface presses the outer surface of the transfer belt to bend the belt inwardly;

a torque limiter having a specified cutoff torque and mounted on a rotary shaft of the bending roller;

a drive motor for giving a driving force to the bending roller via the torque limiter; and a drive controller for driving the drive motor such that the circumferential speed of the bending roller is faster than the rotating speed of the transfer belt, wherein the cutoff torque of the torque limiter is smaller than a torque received by the bending roller due to a friction between the transfer belt and the bending roller.

6. An image forming apparatus according to claim 5, further comprising a cleaning device for cleaning the outer circumferential surface of the bending roller.

7. An image forming apparatus according to claim 6, wherein the cutoff torque of the torque limiter is larger than a torque received by the bending roller due to a friction between the cleaning device and the bending roller.

8. An image forming apparatus, comprising:

an image bearing member for bearing a toner image in conformity with specified image information;

a transfer belt mounted on a plurality of rollers for transferring the toner image on the image bearing member to the outer surface thereof or a recording sheet placed on the outer surface thereof;

a bending roller whose outer circumferential surface presses the outer surface of the transfer belt to bend the belt inwardly;

a torque limiter having a specified cutoff torque and mounted on a rotary shaft of the bending roller;

a drive motor for giving a driving force to the bending roller via the torque limiter; and a drive controller for driving the drive motor such that the circumferential speed of the bending roller is faster than the rotating speed of the transfer belt, wherein the drive controller drives the drive motor in such a manner as to start the bending roller prior to the start of the transfer belt.

* * * * *